US005775279A

United States Patent [19]

Ogawa et al.

[11] Patent Number: 5,775,279

[45] Date of Patent: Jul. 7, 1998

[54] VALVE TIMING CONTROL DEVICE

[75] Inventors: Kazumi Ogawa, Toyota; Katsuhiko Eguchi, Kariya; Kongo Aoki, Toyota, all of Japan

[73] Assignee: Aisin Seiki Kabushiki Kaisha, Kariya, Japan

[21] Appl. No.: 828,937

[22] Filed: Mar. 28, 1997

[30] Foreign Application Priority Data

Mar. 28, 1996 [JP] Japan ..... 8-074823
Mar. 17, 1997 [JP] Japan ..... 9-063247

[51] Int. Cl.[6] ..... F01L 1/344

[52] U.S. Cl. ..... 123/90.17; 123/90.31

[58] Field of Search ..... 123/90.15, 90.17, 123/90.31; 74/567, 568 R; 464/1, 2, 160

[56] References Cited

U.S. PATENT DOCUMENTS 5,181,484 1/1993 Kan et al. ..... 123/90.17

5,666,914 9/1997 Ushida et al. ..... 123/90.17

*Primary Examiner*—Weilun Lo

*Attorney, Agent, or Firm*—Hazel & Thomas

[57] ABSTRACT

A valve timing control device comprising a rotor fixed on a cam shaft of an engine, a housing member rotatably mounted on the cam shaft so as to surround the rotor is disclosed. The valve timing control device also comprises a chamber defined between the housing member and the rotor and having a pair of circumferentially opposed walls, a vane mounted on the rotor and extended outwardly therefrom, in the radial direction into the chamber so as to divide the chamber into a first pressure chamber and a second pressure chamber, a fluid supplying means for supplying fluid under pressure to at least a selected one of the first pressure chamber and the second pressure chamber and a force means for expanding one of the first pressure chamber and the second pressure chamber.

7 Claims, 8 Drawing Sheets

VALVE TIMING CONTROL DEVICE

RELATED U.S. PATENT APPLICATIONS

This application is related to pending U.S. patent application Ser. No. 0/8,757,857, filed Dec. 2, 1996, and entitled "Valve Timing Control Device."

FIELD OF THE INVENTION

The present invention relates to a valve timing control device and, in particular, to a valve timing control device for controlling an angular phase difference between a crank shaft of a combustion engine and a cam shaft of the combustion engine.

BACKGROUND OF THE INVENTION

In general, valve timing of an internal combustion engine is determined by valve mechanisms driven by cam shafts according to either a characteristic or a specification of an internal combustion engine. Since a condition of the combustion is changed in response to the rotational speed of the combustion engine, however, it is difficult to obtain optimum valve timing through the entire rotational range. Therefore, a valve timing control device which is able to change the valve timing in response to the condition of the internal combustion engine as an auxiliary mechanism of the valve mechanism has been proposed in recent years.

A conventional device of this kind is disclosed, for example, in U.S. Pat. No. 4,858,572. This device includes a rotor which is fixed on the cam shaft, a drive member which is driven by the rotational torque from a crank shaft and which is rotatably mounted on the cam shaft so as to surround the rotor, a plurality of chambers which are defined between the drive member and the rotor, each having a pair of circumferentially opposed walls and a plurality of vanes which are mounted to the rotor and which extend outwardly therefrom in the radial direction into the chambers so as to divide each of chambers into a first pressure chamber and a second pressure chamber. In this device, a fluid under pressure is supplied to a selected one of the first pressure chamber and the second pressure chamber in response to the running condition of the combustion engine, and controlling an angular phase difference between the crank shaft and the cam shaft so as to advance or retard the valve timing relative to the crank shaft. The fluid under pressure is delivered from an oil pump. The valve timing control device is in the position of the maximum advanced condition, when each of the vanes is in contact with one of the opposed walls of each of the chambers. On the other hand, the valve timing control device is in the position of the maximum retarded condition when each of the vanes is in contact with the other of the opposed walls of each of the chambers.

In the above prior art device, when the internal combustion engine is stopped, the oil pump stops delivering the fluid under pressure. The fluid under pressure in the first pressure chamber and the second pressure chamber is decreased with the lapse of time. After then, when the combustion engine is restarted, there is not enough of the fluid under pressure in the chambers. Therefore, each of the vanes rotates to retard the valve timing and crashes against the walls of each of the chambers. This crashing sound can be bothersome to a driver and passengers.

Further, if the cam shaft for controlling some exhaust valves attaches the above prior art device, the opening and closing timing of the exhaust valves is delayed because of the above operation of retarding the valve timing. It increases an overlap phenomenon. The overlap phenomenon means the exhaust valves and the intake valves are opening at the same time. When the induction stroke of the combustion engine at the overlap phenomenon occurs, the sucked charge (fuel and air) from an intake port is discharged through an exhaust port before being ignited by a spark plug so as to burn angularly and increase the pollutant content in the exhaust gas.

SUMMARY OF THE INVENTION

Accordingly, it is an object of the present invention to provide an improved valve timing control device without the foregoing drawbacks.

In accordance with the present invention, a valve timing control device comprising a rotor fixed on a cam shaft of an engine, a housing member rotatably mounted on the cam shaft so as to surround the rotor, a chamber defined between the housing member and the rotor and having a pair of circumferentially opposed walls, a vane mounted on the rotor and extended outwardly therefrom in the radial direction into the chamber so as to divide the chamber into a first pressure chamber and a second pressure chamber, a fluid supplying means for supplying fluid under pressure to at least a selected one of the first pressure chamber and the second pressure chamber and a force means for expanding one of the first pressure chamber and the second pressure chamber.

Other objects and advantages of invention will become apparent during the following discussion of the accompanying drawings.

BRIEF DESCRIPTION OF THE DRAWING FIGURES

The foregoing and additional features of the present invention will become more apparent from the following detailed description of preferred embodiments thereof when considered with reference to the attached drawings, in which.

DETAILED DESCRIPTION OF THE PREFERRED EMBODIMENTS

A valve timing control device in accordance with preferred embodiments of the present invention will be described with reference to the attached drawings.

Figure 1:
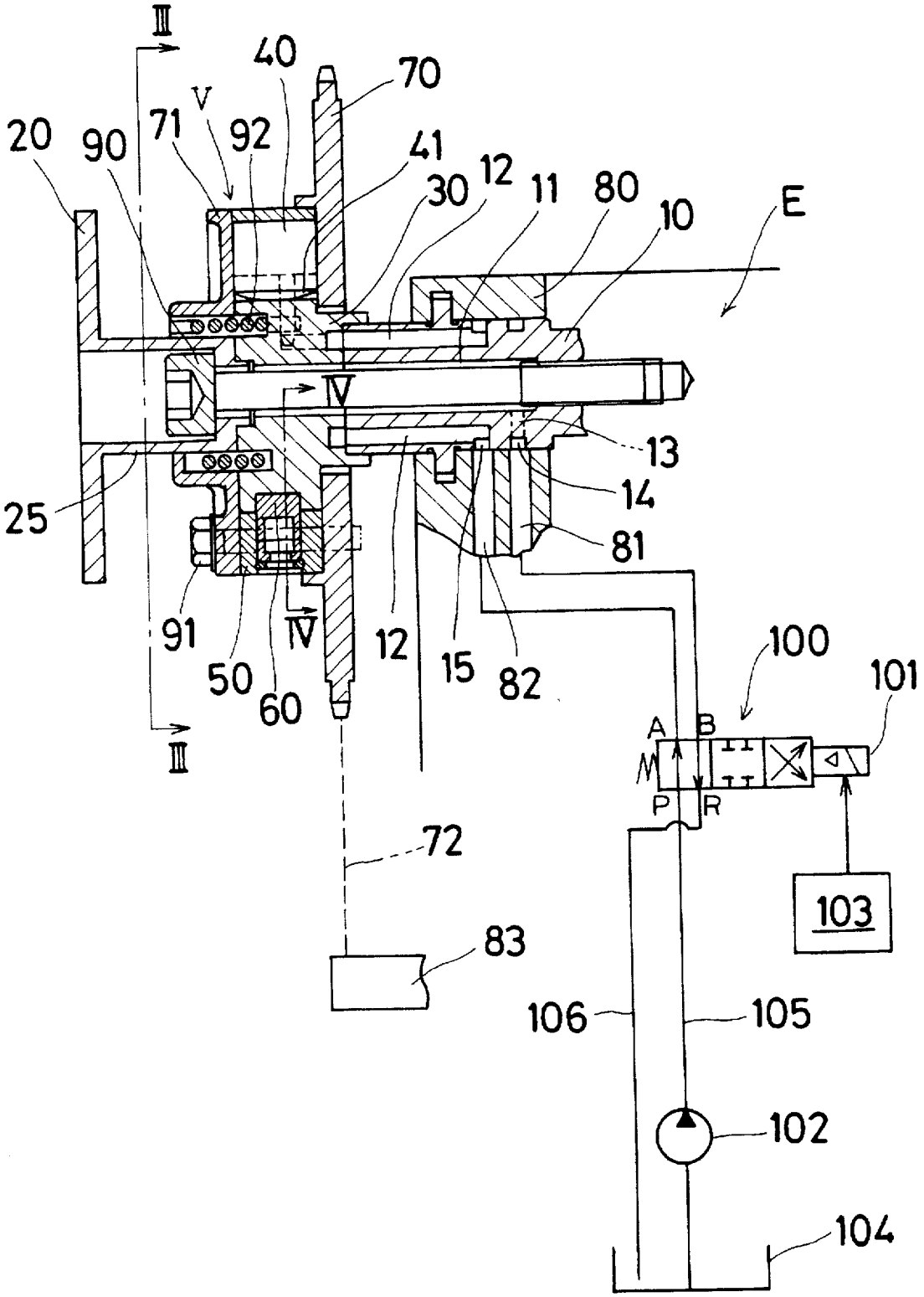
FIG. 1 is a sectional view of the first embodiment of a valve timing control divide in accordance with the present invention.
Figure 2:
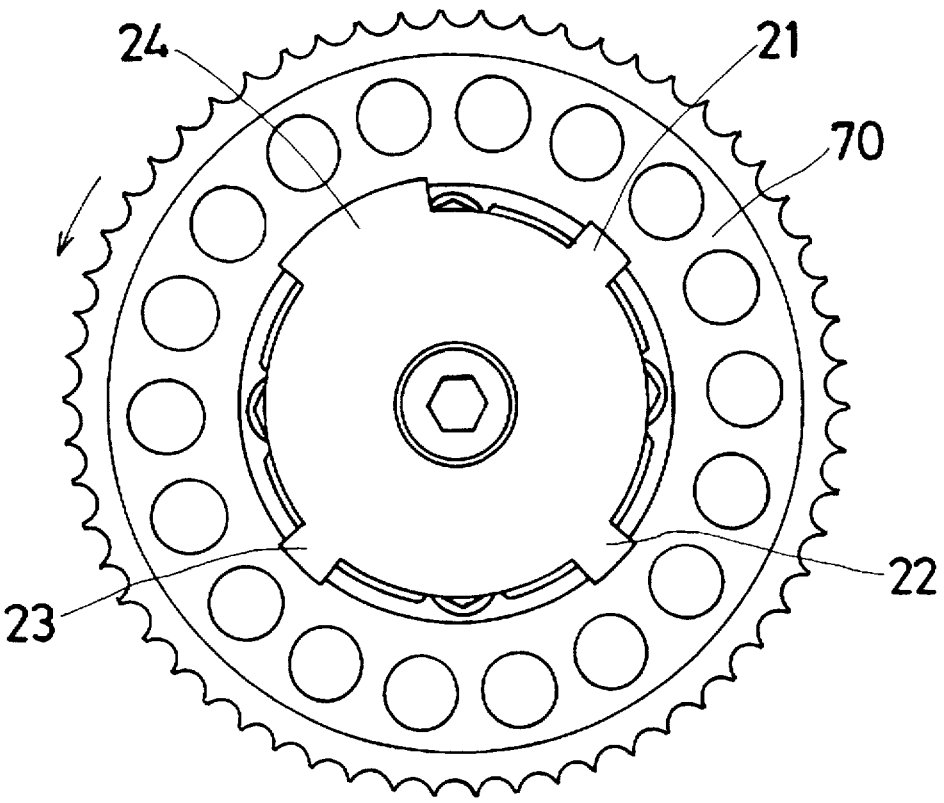
FIG. 2 is a side view in FIG. 1 in accordance with the present invention.
Figure 3:
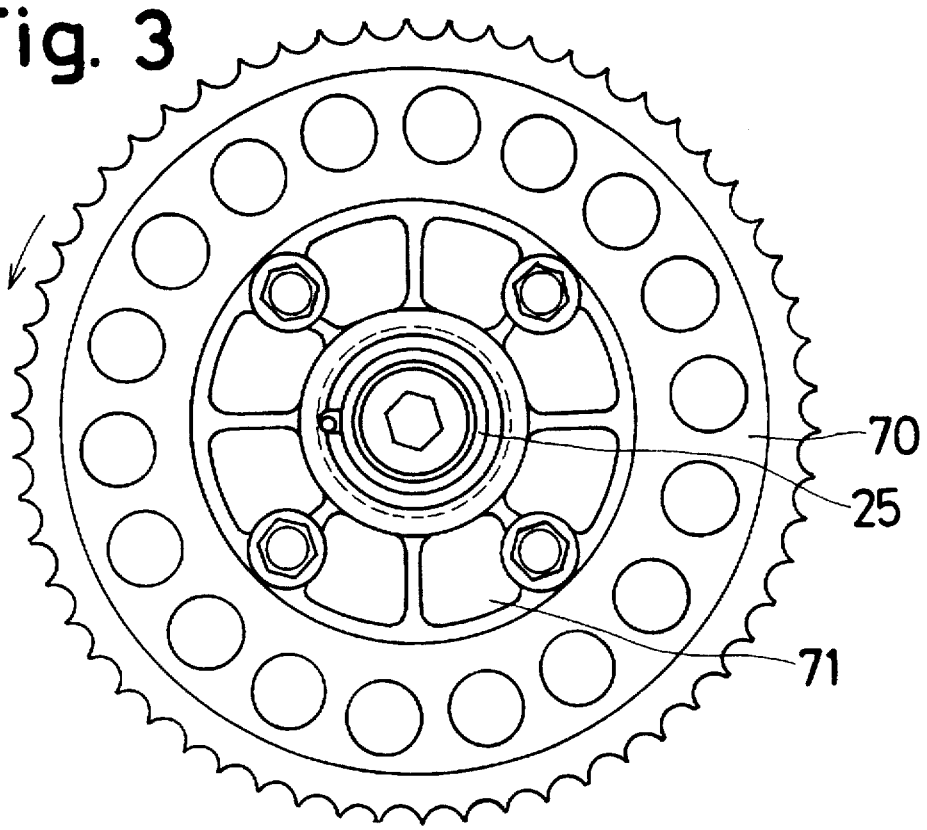
FIG. 3 is a sectional view taken along the line III—III in FIG. 1 in accordance with the present invention.

FIGS. 1 through 7 to show a first embodiment of the present invention. Referring to FIG. 1, a valve timing control device of the first embodiment includes an exhaust cam shaft 10, a sensor plate 20, a rotor 30, a plurality of vanes 40 and a housing 50. The exhaust cam shaft 10 is rotatably mounted on a cylinder head 80 of an engine E. The exhaust cam shaft 10 has two circular grooves 14, 15. Both the circular grooves 14, 15 are formed so as to maintain a predetermined distance between each other. Both the sensor plate 20 and the rotor 30 are fixed to the projecting end of the exhaust cam shaft 10 by a bolt 90. The sensor plate 20 has three short projections 21, 22, 23 in the circumferential direction and a long projection 24 in the circumferential direction as shown FIG. 2. The sensor plate 20 has a brim 25. The rotor 30 has a plurality of grooves for inserting the vane 40 as shown in FIGS. 4 through 7. One side end of the housing 50 is fixed to a timing pulley 70 and the other side end of the housing 50 is fixed to a side plate 71 by a bolt 91. Therefore, the housing 50, the timing pulley 70 and the side plate 71 act in a body. The timing pulley 70 transmits rotational torque via a belt 72 (or a chain 72) from a crank shaft 83 which is rotated by the engine E. A pin 60 allows connection between the rotor 30 and the housing 50 when the rotor 30 is in phase with the housing 50.

The exhaust cam shaft 10 has a plurality of cams (not shown). Each cam makes the exhaust valves open and close. There is a passage 11 which is formed in the exhaust cam shaft 10 at its axial center and extends in the axial direction. One end of the passage 11 communicates with the circular groove 14 through a passage 13. The circular groove 14 is communicated with a passage 81 which is formed in the cylinder head 80 of an engine E. On the other hand, there are a plurality of passages 12 which are formed in the exhaust cam shaft 10 so as to locate on the coaxial circle about the axial center of the shaft 10 and which are extended in parallel in the axial direction. One end of the passage 12 communicates with the circular groove 15. The circular groove 15 is communicated with a passage 82 which is formed in the cylinder head 80 of an engine E. Both the passage 81 and 82 is communicated with a fluid supplying device 100. The fluid supplying device 100 is comprised of a changeover valve 101, a fluid pump 102 and a controller 103. In this embodiment, the changeover valve 101 is a four port-three position type electromagnetic valve. The fluid pump 102 is driven by the engine E and discharges the fluid (=oil) for lubricating the engine E. The pump 102 may be a pump for lubricating the engine E. The passage 82 is communicated to a port A of the changeover valve 101 and the passage 81 is communicated to a port B of the changeover valve 101. A port P of the changeover valve 101 communicates with a discharge portion of the fluid pump 102 via a passage 105, and a port R of the changeover valve 101 communicates with a reservoir 104 via a passage 106. The portion of the changeover valve 101 is controlled by the controller 103 so that a first condition as shown in FIG. 1 in which the discharged fluid from the pump 102 is supplied to the passage 82 and in which the passage 81 communicates with the reservoir 104, a second condition in which all the ports A, B, P, R are interrupted, a third condition in which the discharged fluid from the pump 102 is supplied to the passage 81 and in which the passage 82 communicates with the reservoir 104 are selectively obtained. The controller 103 controls the above conditions of the changeover valve 101 based on parameter signals such as engine speed, the opening level of a throttle valve (not shown) and so on.

In the rotor 30 and the housing 50, a valve timing control mechanism V is mounted therein. The rotor 30 has a cylindrical shape. As shown in FIGS. 4 through 7, the housing 50 has an inner bore 54 and is rotatably mounted on the outer circumferential surface of the rotor 30 so as to surround the rotor 30. The housing 50 has the same axial length as the rotor 30 and is provided with a plurality of grooves 51 which are outwardly extended from the inner bore 54 in the radial direction and which are separated in the circumferential direction at regular intervals. The housing 50 is also provided with a plurality of holes 53 for penetration of the bolt 91. The holes 53 penetrate in the axial direction and separate in the circumferential direction at regular intervals.

Thereby, a plurality of chambers RO which are separated in the circumferential direction at regular intervals and each of which has a pair of circumferentially opposed walls 55 and 56 are defined along the rotor 30, the housing 50, the timing pulley 70 and the side plate 71. On the outer circumferential portion of the rotor 30 are some grooves 31. The numbers of the grooves 31 is equal to the numbers of the chambers RO. Each of the grooves 31 extends inwardly therefrom in the radial direction and is separated in the circumferential direction at regular intervals formed thereon. Each of the vanes 40 that extends outwardly in the radial direction into each of the chambers RO is mounted in each of the grooves 31, respectively. Thereby, each of the chambers RO is divided into a first pressure chamber R1 and a second pressure chamber R2, both of which are fluid-tightly separated from each other.

The housing 50 has a hole 52 which extends inwardly thereof in the radial direction and which is penetrated in the radial direction. The hole 52 accommodates the pin 60 which is pushed forward the rotor 30 by a coil-spring 61. The coil-spring 61 is supported by a clip 63 through a retainer 62. On the other hand, the rotor 30 on the outer circumferential surface has a hole 32 which extends inwardly thereof in the radial direction so as to insert the pin 60.

The rotor 30 is provided with a plurality of first passages 34, a plurality of second passages 36, and a passage 35. The first passages 34 and the passage 35 are communicated. One end of each of the first passages 34 communicates with the passage 11 and the other end of the first passages 34 communicates with each of the first chambers R1. On the other hand, one end of each of the first passages 36 communicates with the passage 12 and the other end of the second passages 36 communicates with each of the second chambers R2.

There is a coil-spring 92. One end of the coil-spring 92 is connected with the rotor 30 and the other end of the coil-spring 92 is connected with the side plate 71 which is fixed to the housing 50. The outer surface of the brim 25 of the sensor plate 20 guides the coil portion of the coil-spring 92 as shown in FIG. 1.

The operation of the valve timing control device having the above structure will now be described.

The exhaust camshaft 10 is rotated counterclockwise by timing pulley 70. Thereby, exhaust valves (not shown) are opened and closed. The pressure of fluid delivered from the oil pump 102 is increased. Fluid under the resulting pressure is supplied to the changeover valve 101. At the time, the changeover valve 101 is the first condition as shown in FIG. 1, fluid is supplied to the chambers R2 via the passage 82, the passage 12 and second passages 36. Thereby, the vanes 40 are rotated in the counterclockwise direction, together with the rotor 30 and the exhaust cam shaft 20. Upon fitting of the pin 60 into the hole 32 of the rotor 30, such rotation is terminated. Thus, the exhaust cam shaft 20 is advanced through an angle relative to the crank shaft 83.

Figure 5:
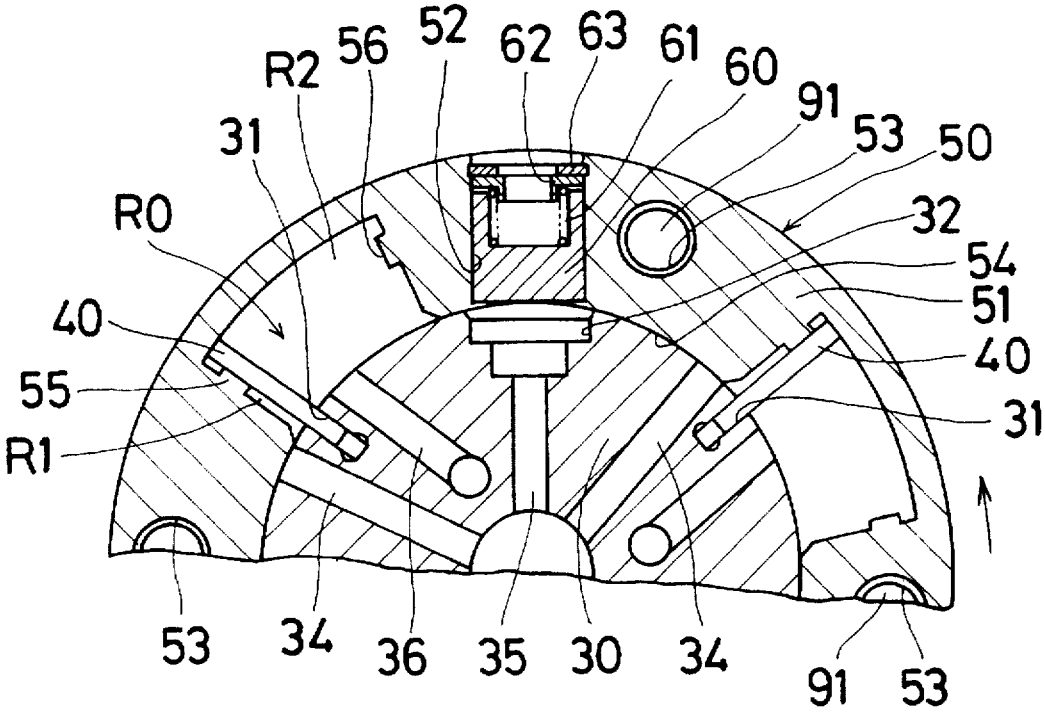
FIGS. 5, 6 and 7 are three views similar to FIG.4, showing various modifications.
Figure 6:
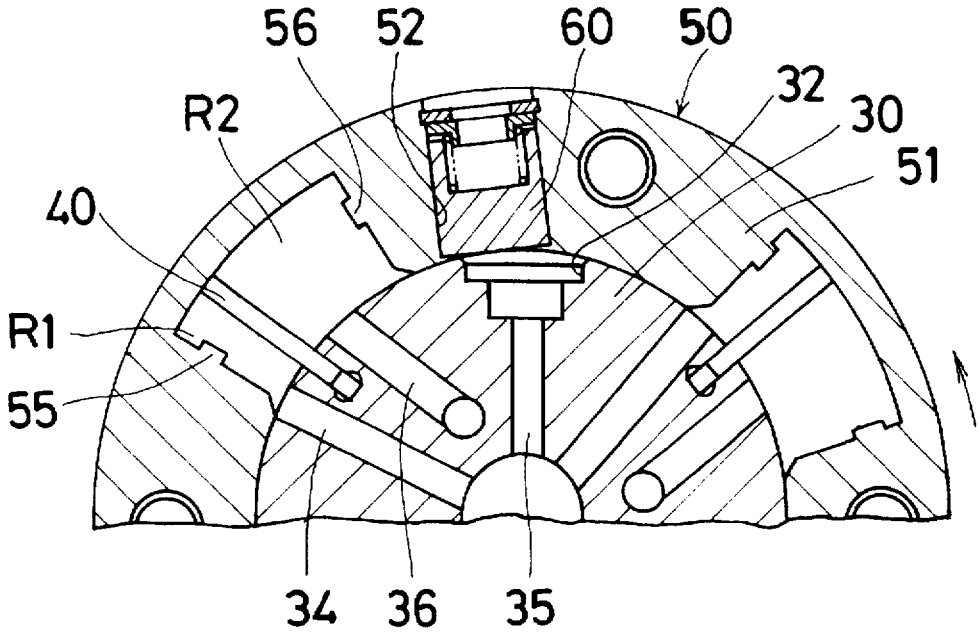
Figure 7:
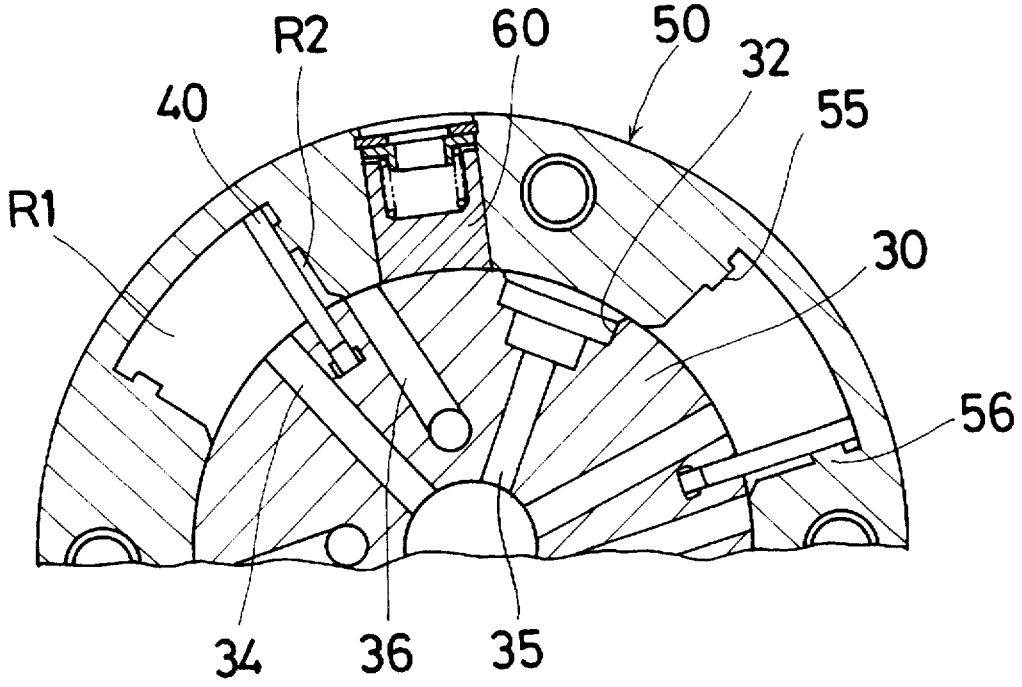

On the other hand, for returning the exhaust cam shaft 20 from the advanced condition to the retard condition, the vanes 40 are rotated in the clockwise direction by supplying fluid under pressure to the chambers R1 via the passage 81, the passage 11 and first passages 34. Since the first passage 34 is communicated with the passage 35, fluid under pressure supplied into the hole 32 urges the pin 60 fully into the hole 52 of the housing 50 as shown in FIG. 5, thereby releasing the connection between the rotor 30 and the housing 50. With increasing pressure in the chamber R1, the vanes 40 are rotated in the clockwise direction as shown in FIG. 7 via the condition as shown in FIG. 6. During the retarding rotary movement of the vanes 40, fluid in each chambers R2 is drained to the reservoir 104 through the passage 36, the passage 12, second passages 82 and the changeover valve 101.

When the engine E is stopped, the fluid pressure in the chambers R1 and R2 is drained with the lapse of time through a non-illustrated clearance between each part, e.g., between the exhaust cam shaft 20 and the cylinder head 80. Therefore, the coil-spring urges the rotor 30 in the counter-clockwise direction so as to fit the pin 60 into the hole 32 of the rotor 30.

Figure 8:
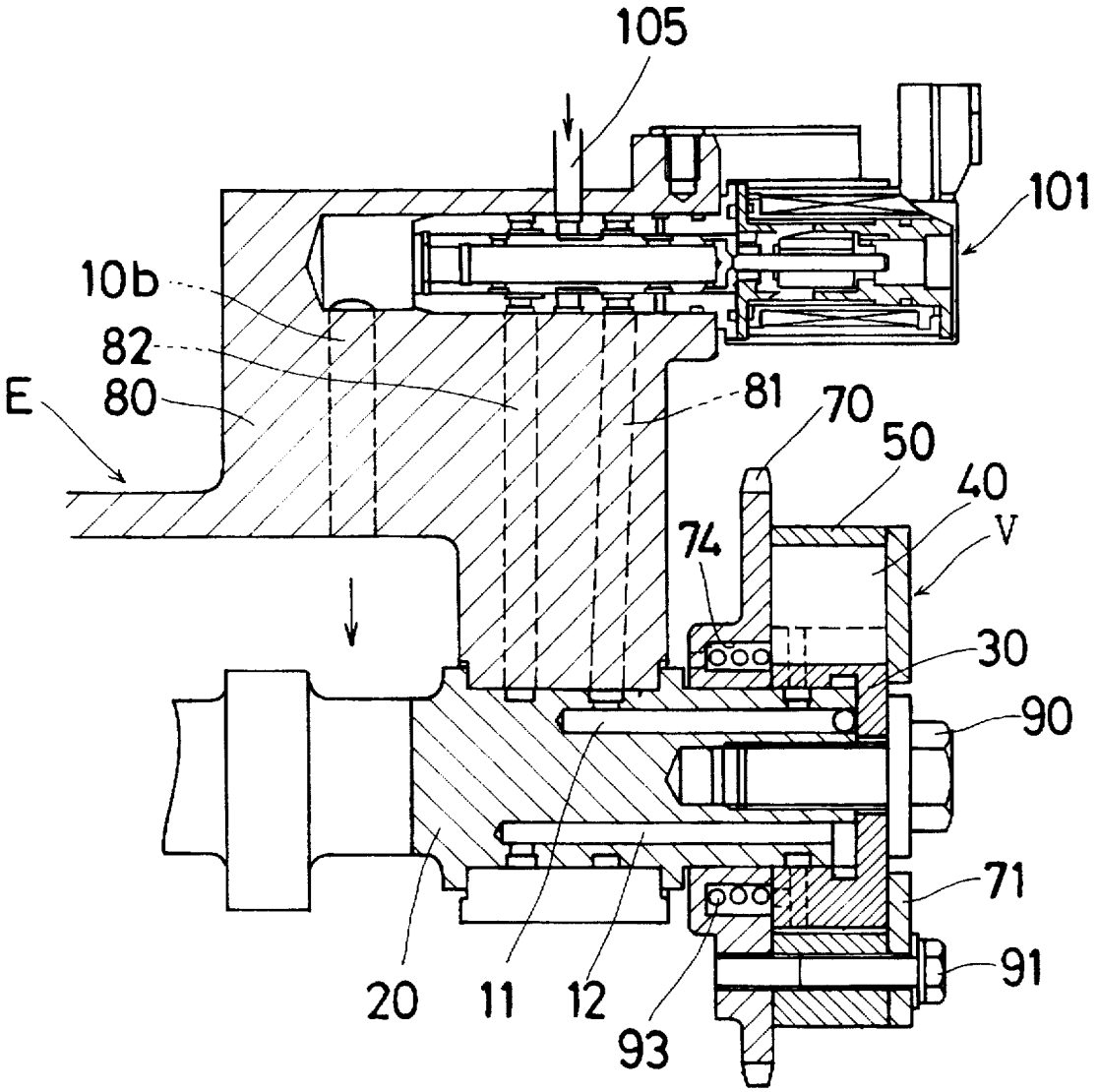
FIG. 8 is a sectional view, similar to FIG. 1, of the second embodiment of a valve timing control divide in accordance with the present invention.

FIG. 8 illustrates a modified version of the first preferred embodiment, which specifically is a modified arrangement of a coil-spring 93. In FIG. 8, the same parts in FIG. 1 use the same numerals of FIG. 1. In this modified construction, the coil-spring 93 is arranged between a valve timing control mechanism V and the engine E. The timing pulley 70 has a cylindrical hollow 73. The cylindrical hollow 73 accommodates the coil-spring 93 wherein one end thereof is connected with the rotor 30 and wherein the other end thereof is connected with the timing pulley 70 which is fixed to the housing 50.

Figure 9:
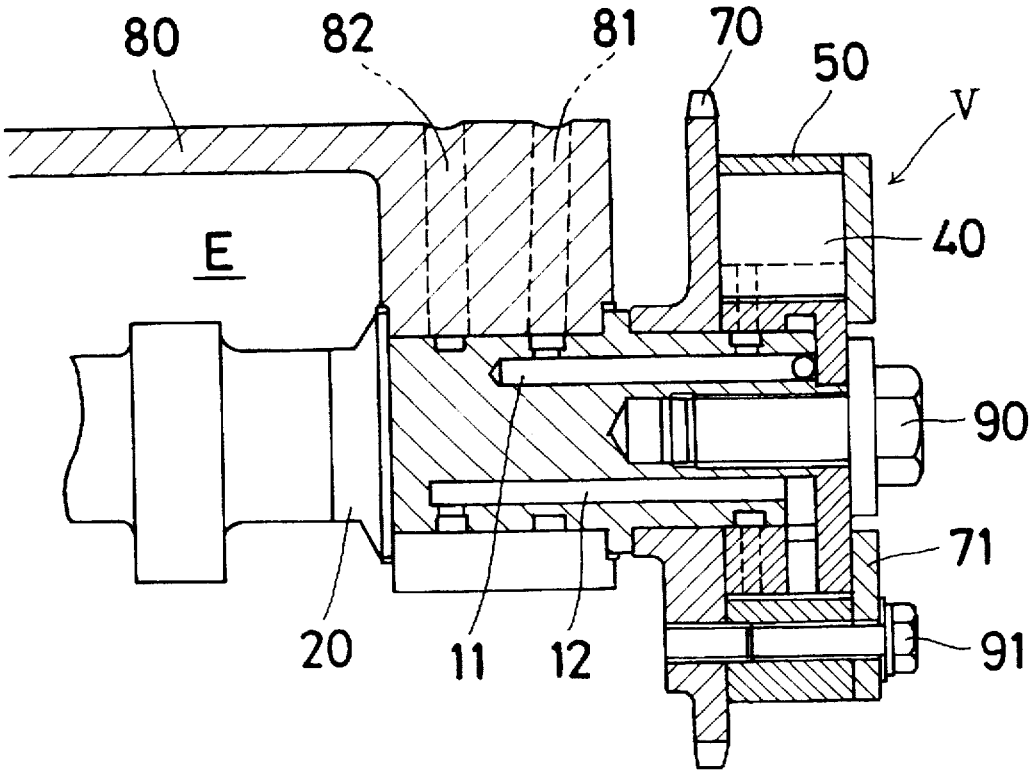
FIGS. 9 and 10 are sectional views, similar to FIG. 1 of the third embodiment of a valve timing control divide in accordance with the present invention.
Figure 10:
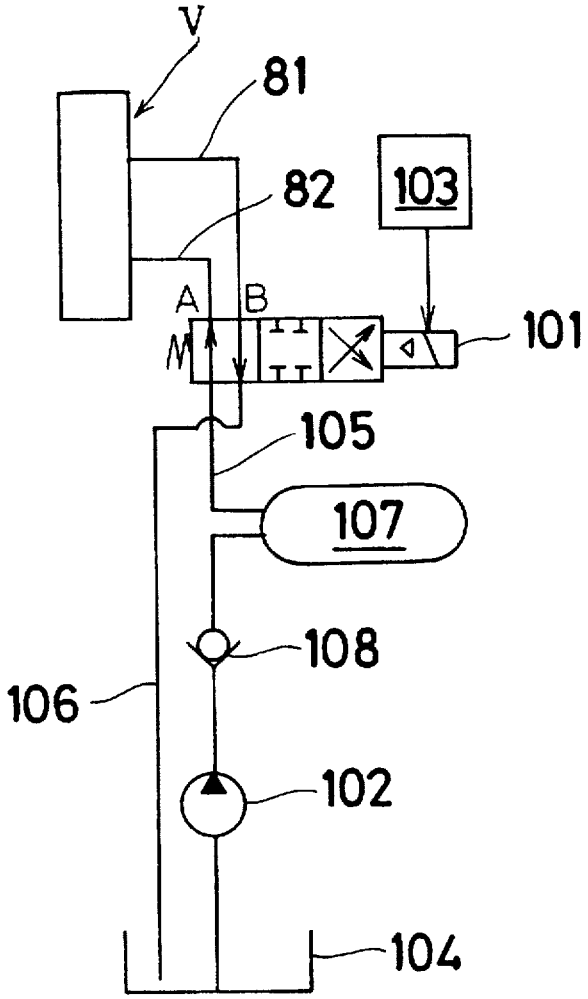

FIGS. 9 and 10 illustrate a modified version of the first preferred embodiment, which specifically is a modified construction of an accumulator 107 and a check valve 108. In FIGS. 9 and 10, the same parts in FIG. 1 also use the same numerals of FIG. 1. In this modified construction, a valve timing control mechanism V has no spring between the rotor 30 and the housing 50 is shown in FIG. 9. On the other hand, the fluid supplying device has both the accumulator 107 and the check valve 108. The accumulator 107 and the check valve 108 are located on the passage 106 which is discharged from the oil pump 102. The check valve 108 is located between the oil pump 102 and the accumulator 107.

Figure 4:
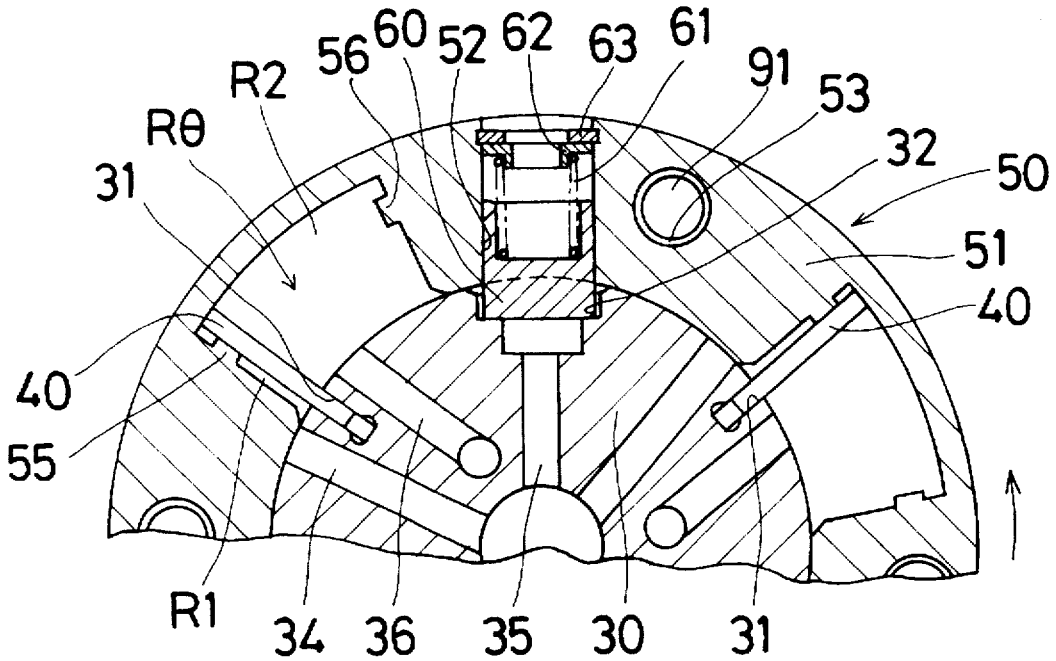
FIG. 4 is a sectional view taken along the line IV—IV in FIG. 1 in accordance with the present invention.

When the engine E is in operation, the oil pump discharges fluid under pressure to the passage 105 and the accumulator 107 accumulates fluid under pressure. If the engine E stops, the controller 103 controls the changeover valve 101 in the first condition in which the discharged fluid from the accumulator 107 is supplied to the passage 82 and in which the passage 81 communicates with the reservoir 104 via the passage 106. Thereby, the fluid under pressure of the chamber R2 is increased, and the fluid under pressure of the chamber R1 is decreased so that the vanes 40 are able to rotate in the clockwise direction and the pin 60 fits into the hole 32 of the surface of the rotor 30 as shown in FIG. 4.

While the invention has been described in connection with one of its preferred embodiments, it should be understood that changes and modifications may be made without departing from the scope and spirit of the appended claims.

What is claimed is:

1. A valve timing control device comprising:

a rotor fixed on a cam shaft of an engine;

a housing member rotatably mounted on the cam shaft so as to surround said rotor;

a chamber defined between said housing member and said rotor and having a pair of circumferentially opposed walls;

a vane mounted on said rotor and extending outwardly therefrom in the radial direction into said chamber so as to divide said chamber into a first pressure chamber and a second pressure chamber;

a fluid supplying means for supplying fluid under pressure to at least one of said first pressure chamber and said second pressure chamber; and a force means for expanding one of said first pressure chamber and said second pressure chamber.

2. The valve timing control device of claim 1, wherein the force means is a coil-spring, wherein one end of said coil-spring is affixed to said the rotor, and the other end of said coil-spring is affixed to the housing member.

3. The valve timing control device of claim 2, wherein both the rotor and the housing are arranged between the coil-spring and the engine.

4. The valve timing control device of claim 3, wherein the coil-spring is guided by a sensor plate which is arranged at the end of the cam shaft.

5. The valve timing control device of claim 4, wherein the cam shaft controls an exhaust valve.

6. The valve timing control device of claim 1, wherein the force means includes an accumulator which accumulates fluid under pressure and supplies to one of the first pressure chamber or the second pressure chamber.

7. The valve timing control device of claim 6, wherein the supplying means includes a fluid under pressure source and a control valve to control fluid under pressure in the first pressure chamber and the second pressure chamber, and an accumulator located between said fluid under pressure source and said control valve.

* * * * *